US006616992B2

(12) United States Patent
Ito et al.

(10) Patent No.: US 6,616,992 B2
(45) Date of Patent: Sep. 9, 2003

(54) RECORDING SHEET

(75) Inventors: Akio Ito, Kanuma (JP); Jun Takahashi, Kanuma (JP); Yukiko Murasawa, Kanuma (JP); Hideaki Takahashi, Kanuma (JP)

(73) Assignee: Sony Chemicals Corp. (JP)

( * ) Notice: Subject to any disclaimer, the term of this patent is extended or adjusted under 35 U.S.C. 154(b) by 0 days.

(21) Appl. No.: 10/001,373

(22) Filed: Oct. 23, 2001

(65) Prior Publication Data

US 2002/0071942 A1 Jun. 13, 2002

(30) Foreign Application Priority Data

Oct. 24, 2000 (JP) ..... 2000-323868

(51) Int. Cl.[7] ..... B41M 5/00
(52) U.S. Cl. ..... 428/32.25
(58) Field of Search ..... 428/195, 212, 428/323, 328, 331, 480, 32.25, 32.28, 32.34

(56) References Cited

U.S. PATENT DOCUMENTS

| | | | | | |
|---|---|---|---|---|---|
| 4,642,247 | A | | 2/1987 | Mouri et al. | 427/214 |
| 4,877,678 | A | | 10/1989 | Hasegawa et al. | 428/216 |
| 4,931,423 | A | * | 6/1990 | Uemura et al. | 503/227 |
| 5,025,061 | A | * | 6/1991 | Ishidoya et al. | 524/539 |
| 5,144,334 | A | * | 9/1992 | Suzuki et al. | 346/1.1 |
| 5,147,689 | A | * | 9/1992 | Igarashi et al. | 427/264 |
| 5,700,867 | A | * | 12/1997 | Ishiyama et al. | 524/539 |
| 5,705,451 | A | * | 1/1998 | Takao et al. | 503/227 |
| 6,001,165 | A | * | 12/1999 | Shibuya et al. | 106/287.17 |
| 6,028,028 | A | * | 2/2000 | Nitta | 503/200 |
| 6,291,127 | B1 | * | 9/2001 | Dagan et al. | 430/201 |
| 6,364,984 | B1 | * | 4/2002 | Ueno et al. | 156/235 |
| 6,409,334 | B1 | * | 6/2002 | Campbell et al. | 347/106 |
| 6,447,883 | B1 | * | 9/2002 | Chen et al. | 428/195 |
| 6,457,824 | B1 | * | 10/2002 | Wexler | 347/105 |
| 6,475,603 | B1 | * | 11/2002 | Wexler | 428/195 |
| 6,481,843 | B1 | * | 11/2002 | Landry-Coltrain et al. | 347/105 |
| 6,489,008 | B1 | * | 12/2002 | Campbell et al. | 428/195 |
| 6,498,123 | B2 | * | 12/2002 | Suzuki et al. | 503/227 |

FOREIGN PATENT DOCUMENTS

EP 0 633 508 A2 1/1995

OTHER PUBLICATIONS

European Search Report, Application No. EP 01 12 5238, dated Aug. 30, 2002, 3 pages.

* cited by examiner

*Primary Examiner*—B. Hamilton Hess
*Assistant Examiner*—B. Shewareged
(74) *Attorney, Agent, or Firm*—Rosenthal & Osha L.L.P.

(57) ABSTRACT

The recording sheet has an ink-receiving layer and an ink permeable layer. The ink permeable layer is arranged on a surface of the ink-receiving layer and includes a filler and a binder. The binder contains as a primary component a water-insoluble polyester resin having a high hydroxyl value in the range of 25 to 65. The ink permeable layer 13 has a significant ink phobicity. The ink permeable layer does not contain a surfactant and is low lipophilic. Thus, when it receives ink containing an organic solvent, the ink does not disperse within the ink permeable layer to provide printed images without bleeding.

8 Claims, 1 Drawing Sheet

RECORDING SHEET

BACKGROUND OF THE INVENTION

1. Field of the Invention

The present invention relates to recording sheets for recording information using ink, or the like. In particular, the present invention relates to recording sheets for use with inkjet printers.

2. Description of the Related Art

Commonly used recording sheets for inkjet printing have a three-layered structure as shown in FIG. 3*a*; an inkjet recording sheet 110 includes a resin film base sheet 111, an ink-receiving layer 112 formed on the base sheet 111, and an ink permeable layer 113 formed on the ink-receiving layer 112.

As shown in FIG. 3*b*, when an ink drop 114 injected from a nozzle of an inkjet printer (not shown) strikes the surface of the ink permeable layer 113 of the recording sheet 110, a coloring agent and/or a solvent present in the ink permeate through the ink permeable layer 113 and the coloring agent is fixed within the ink-receiving layer 112. The ink fixed within the ink-receiving layer 112 is denoted by reference numeral 117 in FIG. 3*b*.

In general, aqueous ink is used for inkjet printers. The conventional recording sheet 110, therefore, uses a hydrophobic resin, such as a water-insoluble polyester resin, which has a low affinity with water, in the water permeable layer 113 in order to allow the aqueous ink to permeate through the layer.

However, aqueous ink typically contains various organic solvents for the purpose of preventing drying ink in addition to water. Examples of such organic solvents include polyols such as ethylene glycol, diethylene glycol, triethylene glycol, propylene glycol, polyethylene glycol, and glycerol; alkyl ether derivatives of polyols such as ethylene glycol monomethyl ether, ethylene glycol monoethyl ether, diethylene glycol monomethyl ether, diethylene glycol monoethyl ether, diethylene glycol monobutyl ether, diethylene glycol dimethyl ether, diethylene glycol diethyl ether, diethylene glycol methyl ethyl ether, triethylene glycol monomethyl ether; ester derivatives of polyols such as ethylene glycol monomethyl ether acetate, diethylene glycol monoethyl ether acetate, glyceryl monoacetate, and glyceryl diacetate; water-soluble amines such as monoethanolamine, diethanolamine, triethanolamine, and polyoxyethylene amine; and nitrogen-containing cyclic compounds such as 2-pyrrolidone, and N-methyl-2-pyrrolidone.

A drawback of these organic solvents is that the high affinity of these solvents to hydrophobic resins such as water-insoluble polyester may cause the ink to disperse laterally in the ink permeable layer, resulting in bleeds in printed images. What is needed, therefore, is a recording sheet that reduces bleeding in printed images.

SUMMARY OF THE INVENTION

The present invention provides a recording sheet having an ink-receiving layer and an ink permeable layer, the ink permeable layer being arranged on a surface of the ink-receiving layer and the ink permeable layer is including a filler and a binder, wherein the binder contains as a primary component a water-insoluble polyester resin having a high hydroxyl value in the range of 25 to 65. In one embodiment of the present invention, the filler may contain silica as a primary component.

In one embodiment of the present invention, the recording sheet comprising a base sheet attached to the ink-receiving layer.

In one embodiment of the present invention, the ink-receiving layer comprises at least one resin selected from the group consisting of; natural resins including albumin, casein, starch, gum arabic, and sodium alginate, synthetic resins including carboxymethyl cellulose, hydroxyethyl cellulose, polyamide, polyethylene imine, polyvinyl pyrrolidone, polyvinyl alcohol, polyvinyl acetal, melamin, polyester, polyacryl, polyurethane, and polyallyl amine.

In one embodiment of the preset invention, the filler comprises at least one compound selected from the group consisting of talc, kaolin, clay, zinc oxide, tin oxide, aluminum oxide, aluminum hydroxide, calcium carbonate, titanium white, barium sulfate, titanium dioxide, aluminum silicate, magnesium silicate, magnesium oxide, smectite, zeolite, and diatomite.

In one embodiment of the present invention, the hydroxyl value is in the range between 25 and 45.

In one embodiment of the present invention, the hydroxyl value is in the range between 45 and 60.

In one embodiment of the present invention, the base sheet comprises polyethylene terephthelate.

In one embodiment of the present invention, the base sheet comprises at least one compound selected from the group consisting of polyethylene naphthalate, polyolefins including polyethylene and polypropylene, polyvinyl chloride, polystyrene, polymethyl methacrylate, polycarbonate, transparent paper, cellulose acetate, polyacrylate, and polyether sulfone.

BRIEF DESCRIPTION OF THE DRAWINGS

These and other objectives and advantages of the present invention will become apparent from the following description with reference to the accompanying drawings, wherein.

DETAILED DESCRIPTION

Recording sheets of the present invention include an ink permeable layer to which a water-insoluble polyester resin having a hydroxyl value of 25 to 65 is added. Not only are such water-insoluble resins less hydrophilic, but they also are less lipophilic due to a large number of hydroxyl groups present in the chemical structure. Therefore, the ink permeable layers including these polyester resins exhibit a high ink phobicity of inkjet printers without using any surfactants such as nonionic surfactants, fluorine-containing surfactants, cationic surfactants, or anionic surfactants. These ink permeable layers make the printed images less susceptible to bleeding.

The recording sheets of the present invention, which dispense with surfactants, can be manufactured in a simple and less costly manner without the need for the maintenance of the surfactants and the step of adding the surfactants.

As used herein, the term "hydroxyl value" refers to a value that indicates the amount of hydroxyl groups present in a polymeric compound such as a resin. The term is defined in Japanese Industrial Standard document JIS K 0070-1992.

The hydroxyl value is given by the number of milligrams of potassium hydroxide required to neutralize an amount of acetic acid which is required to acetylate free hydroxyl groups present in one gram (1 g) of a resin. Therefore, the higher the hydroxyl value (mgKOH/g) is for a compound, the greater the number of hydroxyl groups in that compound.

A preferred embodiment of a recording sheet in accordance with the present invention as well as its production process will now be described with reference to the accompanying drawings.

First, 100 weight parts of a water soluble urethane resin (sold under the name "NS310X" available from TAKAMATSU-YUSHI Co., Ltd.; 14 wt % solid component), which is an ink absorbing resin, were mixed with 2.8 weight parts of aluminum hydroxide as a filler (sold under the name "HIGILITE H42" available from SHOWA-DENKO Co., Ltd) to form a mixture. The mixture was then stirred for 6 hours in a jar mill to produce a coating fluid for an ink-receiving layer.

Figure 1A:
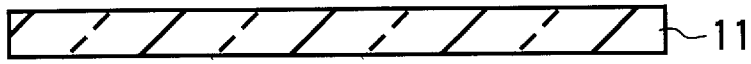
FIGS. 1*a* to 1*c* show manufacturing steps of a recording sheet in accordance with the present invention.

Reference numeral 11 in FIG. 1*a* designates a flexible transparent base sheet made of polyethylene terephthalate. A polyethylene terephthalate film available from TOYOBO Co., Ltd. sold under the name COSMOSHINE A4100 (film thickness: 100 μm, adhesion-facilitating treatment applied on one surface) was used as the base sheet 11.

Figure 1B:
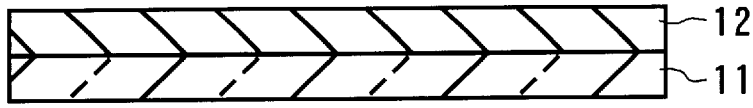

The coating fluid for an ink-receiving layer prepared in the process above was applied to a surface of the base sheet 11 using a bar coater. The coated base sheet was then dried at 120° C. in a hot-air-circulating oven for three minutes to form an ink-receiving layer 12 (FIG. 1*b*). The ink-receiving layer 12 had a thickness of 15 μm after drying.

Next, 56 weight parts of methyl ethyl ketone as an organic solvent and 14 weight parts of cyclohexanone as another organic solvent were added to 15 weight parts of a binder composed of a water-insoluble resin having a high hydroxyl value of 25 or higher. The resulting mixture was stirred for three hours in a jar mill until the binder was completely dissolved to produce a binder solution.

To 85 weight parts of this binder solution, 15 weight parts of silica, available from Mizusawa Industrial Chemicals Ltd. sold under the name "MIZUKASIL" P527 (average particle size 1.6 μm), were added. The resulting mixture was then stirred in a jar mill for one hour to produce a coating fluid for an ink permeable layer.

Next, using a Mayer bar, the coating fluid for the ink permeable layer prepared in the above process was applied to a surface of the ink-receiving layer 12 shown in FIG. 1*b*. The coating fluid was applied so that the resulting layer would have a thickness of 12 μm after drying.

Figure 1C:
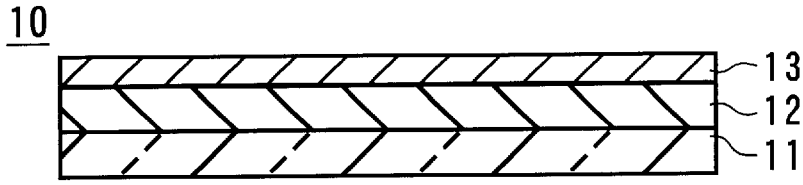

An ink permeable layer 13 was formed after drying at 120° C. in a hot-air-circulating oven for three minutes. The ink permeable layer 13 was formed absent any surfactants. A recording sheet with the ink permeable layer 13 formed thereon is shown in FIG. 1*c* and is denoted by reference numeral 10.

EXAMPLES

Three types of recording sheets 10 were prepared using the same blending ratios and the same processes as the above-described recording sheet and using one of three polyester materials having a high hydroxyl value. The three polyesters are as follows: sold under the name "VYLON 220" available from TOYOBO Co., Ltd., sold under the name "UE3320" from UNITIKA Ltd., and sold under the name "UE3360" from UNITIKA Ltd.

Using the recording sheets 10 prepared as mentioned above, printed images were evaluated as follows.

Evaluation Test of Printed Images

An inkjet printer model FJ-40 manufactured by ROLAND Co., Ltd. was used to inject aqueous ink onto a surface of the ink permeable layer 13 of each recording sheet 10 to print an image. The image was formed such that 6 point outlined Gothic font characters were arranged in a solid background.

These images were evaluated on the following scale: "good" indicates that the outlined characters on the sheet were legible and "bad" indicates that the outlined characters on the sheet were bled and were thus illegible. The results are shown in Table 1 below.

TABLE 1

Evaluation of the printed images in examples of the present invention

| | VYLON 220 | UE 3320 | UE3360 |
|---|---|---|---|
| Evaluation of printed image | good | good | good |

Table 2 shows hydroxyl values, glass transition temperatures, and molecular weights for each of the three types of high hydroxyl value polyesters used in the above examples.

TABLE 2

The hydroxyl values, glass transition temperatures, and molecular weights of the high hydroxyl value polyesters used in the examples

| Binder | Hydroxyl values | glass transition temperature (° C.) | Molecular weight |
|---|---|---|---|
| VYLON 220 | 45 | 53 | 2500 |
| UE 3320 | 60 | 40 | 2000 |
| UE3360 | 25 | 60 | 5000 |

*Hydroxyl values: mg KOH/g

As can be seen from Table 1 above, the outlined characters formed on the printed images were legible for all of the recording sheets 10 in the above examples of the present invention. Accordingly, the ink permeable layer 13 of the recording sheets 10 in accordance with the present invention proved to have a practically sufficient ink phobicity.

Comparative Examples

Three types of coating fluids for the ink permeable layer were prepared using the same three types of high hydroxyl value polyesters as those used in the above examples by the same processes as in the above examples. 5 weight parts of each of four different types of nonionic surfactants were added to 100 weight parts of each of the coating fluids for the ink permeable layer. The four nonionic surfactants were as follows: polyoxyethylene oleyl ether manufactured by NOF Corporation sold under the name "E202S", sorbitan monooleate manufactured by NOF Corporation sold under the name "OP-80R", sorbitan trioleate manufactured by NOF Corporation sold under the name "OP-85R", and sorbitan monolaurate manufactured by NOF Corporation sold under the name "LP-20R". Ten types of recording sheets for comparative examples were then prepared in the same manner as in the examples above.

Using the recording sheets of the comparative examples, printed images were evaluated in the same manner as in the examples. The results are shown in Table 3 below.

TABLE 3

Combinations of surfactants and high hydroxyl value polyesters used in comparative examples and evaluations of the prented images

| | | High hydroxyl value polyester | | |
|---|---|---|---|---|
| | | VYLON 220 | UE 3320 | UE3360 |
| Surfactants | E202S | bad | bad | — |
| | OP-80R | bad | bad | — |
| | OP-85R | bad | bad | bad |
| | LP-20R | bad | bad | bad |

*The mark "—" indicates that the data was not available.

As can be seen from Table 3 above, the outlined characters were illegible in most of the recording sheets of the comparative examples in which the surfactants had been added to the ink permeable layer.

For reference, the HLB values for two of the fluorine-containing surfactants used in the comparative examples and the HLB values for the four nonionic surfactants used in the comparative examples above are presented in Table 4.

TABLE 4

HLB values of surfactants

| Name | HLB values |
|---|---|
| LP-20R | 8.6 |
| OP-80R | 4.3 |
| OP-85R | 1.8 |
| E202S | 4.9 |

While it is believed that, in general, surfactants with higher HLB values have higher hydrophilicity and surfactants with lower HLB values have higher lipophilicity, it has been shown in Tables 1, 3, and 4 that the addition of the surfactants made the printed image more susceptible to bleeding irrespective of the HLB values.

Comparative Examples

Three different types of recording sheets for comparative examples were prepared using the same blending ratios and the same processes as in the above-described examples and using, in place of the high hydroxyl value polyesters in the examples, a water-insoluble polyester having a hydroxyl value of less than 25 and a water-insoluble polyvinyl acetal having a hydroxyl value of greater than 65 as a binder.

The water-insoluble polyester with the hydroxyl value of less than 25, in this case, was "VYLON 200" available from TOYOBO Co., Ltd (molecular weight: 17000, glass transition temperature: 67° C.) or "UE3210" from UNITIKA Co., Ltd (molecular weight: 20000, glass transition temperature: 45° C.). The water-insoluble polyvinyl acetal having the hydroxyl value of greater than 65 was "KS-10" available from SEKISUI KAGAKU Co., Ltd (glass transition temperature: 106° C.).

Using these recording sheets so prepared, printed images were evaluated under the same conditions as in the above-described examples. The evaluations of the images, together with the hydroxyl values of the resins used as the binder, are shown in Table 5 below.

TABLE 5

Evaluations of the printed image of comparative examples

| | Binder | | |
|---|---|---|---|
| | Polyester | | Polyvinyl acetal |
| | VYLON 200 | UE 3210 | KS-10 |
| Hydroxyl value | 4 | 6 | 256 |
| Evaluation of printed image | bad | bad | bad |

*Hydroxyl value: mg KOH/g

As can be seen from Table 5 above, the outlined characters were illegible when the binder was a resin having a hydroxyl value that lies outside the range 25 to 65.

It can be considered that a hydroxyl value of less than 25 makes the affinity of the ink permeable layer for ink so low that the ink does not penetrate into the ink permeable layer and is repelled at the surface, resulting in a reduced printing density.

In contrast, it appears that when the hydroxyl value is greater than 65, the affinity of the ink permeable layer for ink is so high that the ink disperses within the ink permeable layer. In either case, the outlined characters have become illegible because a bleed arose either at the surface of the ink permeable layer or within the ink permeable layer.

While polyethylene terephthalate is used as the material for the base sheet 11 in the above-described examples, the use of other materials as a base sheet is specifically within the scope of the present invention.

Materials that can be used for the base sheet 11 include polyesters such as polyethylene naphthalate, polyolefins such as polyethylene and polypropylene, polyvinyl chloride, polystyrene, polymethyl methacrylate, polycarbonate, transparent paper, cellulose acetate, polyacrylate, and polyether sulfone.

Preferably, the material for the base sheet 11 may be polyethylene terephthalate, hardened polyvinyl chloride, polypropylene, and triacetate for recording sheets for use with over-head projectors. The surface of the base sheet can be treated (adhesion-facilitating treatment i.e.) before forming the ink-receiving layer 12. A base sheet having a base layer on the surface of the base sheet at the side that the ink-receiving layer is formed can be used for the recording sheet of the present invention.

While one embodiment has been described in which the ink-receiving layer 12 is formed on the surface of the base sheet 11, the present invention is not limited to such an embodiment.

Provided that the ink-receiving layer 12 has a sufficient strength, no base sheet 11 is required to support the ink-receiving layer 12 may be dispensed with.

Figure 2:
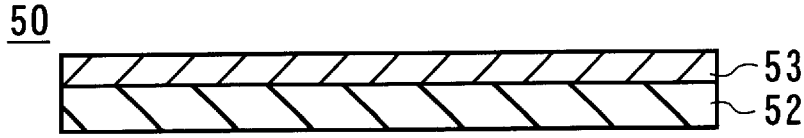
FIG. 2 shows a two layered recording sheet according to another embodiment of the present invention.
Figure 3A:
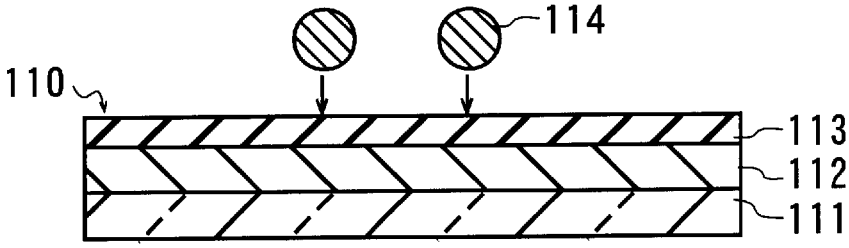
FIGS. 3*a* and 3*b* show the printing process using conventional recording sheets for inkjet printing.
Figure 3B:
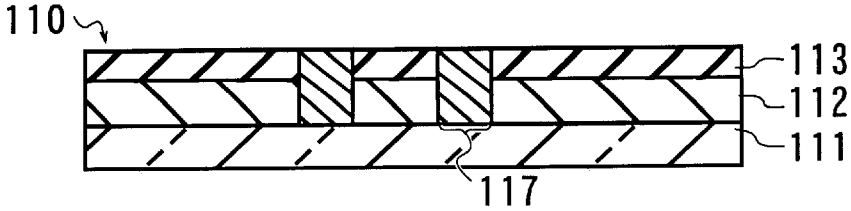

Another embodiment of the recording sheet in accordance with the present invention is denoted by reference numeral 50 in FIG. 2. The recording sheet 50 includes an ink-receiving layer 52 and an ink permeable layer 53 formed on the surface of the ink-receiving layer 52, without a base sheet.

While other materials may be used, the ink-absorbing resins used in the ink-receiving layer 12 may preferably be water-soluble resins having the ability to swell or hydrophilic polymers for the purpose of absorbing and fixing aqueous ink. Examples of suitable ink-absorbing resins include, but are not limited to, natural resins such as albumin, casein, starch, gum arabic, and sodium alginate, synthetic resins such as carboxymethyl cellulose, hydroxyethyl cellulose, polyamide, polyethylene imine, polyvinyl pyrrolidone, polyvinyl alcohol, polyvinyl acetal, melamin, polyester, polyacryl, polyurethane, and polyallyl amine.

While silica may preferably be used as a filler in the ink permeable layer 13, various inorganic fillers may also be used in the ink permeable layer 13 including talc, kaolin, clay, zinc oxide, tin oxide, aluminum oxide, aluminum hydroxide, calcium carbonate, titanium white, barium sulfate, titanium dioxide, aluminum silicate, magnesium silicate, magnesium oxide, smectite, zeolite, and diatomite.

Preferably, the filler used in the ink permeable layer 13 has an average particle size of more than 1 $\mu$m to 10 $\mu$m.

If the filler has an average size of 1 $\mu$m or less, the porous structure has difficulty forming in the ink permeable layer. This results in a reduced ink permeability of the ink permeable layer and thus results in a reduced printing density in the printed images. The filler having the average particle size of greater than 10 $\mu$m reduces the strength of the ink permeable layer and makes the ink permeable layer susceptible to peeling. As a result, handling of the recording sheet may result in deterioration.

While Mayer bars and bar coaters may preferably be used to apply the coating fluids of the ink permeable layer and ink-receiving layer in accordance with the present invention, various other coating equipment may also be used including knife coaters and gravure coaters.

While the ink-receiving layer 12 and ink permeable layer 13 may have various thickness, preferably they have a thickness in the range of 1 $\mu$m to 50 $\mu$m.

As has been described above, the present invention provides recording sheets that are less susceptible to bleeding of the printed images and provide improved color densities.

While reference has been made to specific present embodiments of the invention, it will be understood that various modifications may be made thereto, and it is intended that the appended claims cover all such modification as fall within the true spirit and scope of the invention.

What is claimed is:

1. A recording sheet comprising a base sheet, an ink-receiving layer arranged on said base sheet, and an ink permeable layer arranged on a surface of said ink-receiving layer, said ink permeable layer including a filler and a binder, said binder containing as a primary component a water-insoluble polyester resin having a high hydroxyl value in the range of 25 to 65, said ink-receiving layer including at least one of a water-soluble resin having an ability to swell and a hydrophilic polymer.

2. The recording sheet according to claim 1, wherein said filler contains silica as a primary component.

3. The recording sheet according to claim 1, wherein the ink-receiving layer comprises at least one resin selected from the group consisting of; natural resins including albumin, casein, starch, gum arabic, and sodium alginate, synthetic resins including carboxymethyl cellulose, hydroxyethyl cellulose, polyamide, polyethylene imine, polyvinyl pyrrolidone, polyvinyl alcohol, polyvinyl acetal, melamin, polyester, polyacryl, polyurethane, and polyallyl amine.

4. The recording sheet according to claim 1, wherein the filler comprises at least one compound selected from the group consisting of talc, kaolin, clay, zinc oxide, tin oxide, aluminum oxide, aluminum hydroxide, calcium carbonate, titanium white, barium sulfate, titanium dioxide, aluminum silicate, magnesium silicate, magnesium oxide, smectite, zeolite, and diatomite.

5. The recording sheet according to claim 1, wherein the hydroxyl value is in the range between 25 and 45.

6. The recording sheet according to claim 1, wherein the hydroxyl value is in the range between 45 and 60.

7. The recording sheet according to claim 1, wherein the base sheet comprises polyethylene terephthalate.

8. The recording sheet according to claim 1, wherein the base sheet comprises at least one compound selected from the group consisting of polyethylene naphthalate, polyolefins including polyethylene and polypropylene, polyvinyl chloride, polystyrene, polymethyl methacrylate, polycarbonate, transparent paper, cellulose acetate, polyacrylate, and polyether sulfone.

* * * * *